United States Patent [19]

Davis, Jr.

[11] 4,021,969

[45] May 10, 1977

[54] OBSERVABLE WORKPIECE ABRADING MACHINE

[76] Inventor: James R. Davis, Jr., 348 Chesterfield Circle, Dayton, Ohio 45431

[22] Filed: Mar. 1, 1976

[21] Appl. No.: 662,347

[52] U.S. Cl. ..... 51/135 R; 51/165.72

[51] Int. Cl.[2] ..... B24B 21/00

[58] Field of Search ..... 51/135 R, 165.72, 327

[56] References Cited

UNITED STATES PATENTS

| | | | |
|---|---|---|---|
| 2,231,900 | 2/1941 | Geoffrion | 51/327 |
| 2,594,647 | 4/1952 | Hendrickson | 51/135 R |
| 2,979,867 | 4/1961 | Beaver | 51/165.72 |

*Primary Examiner*—Harold D. Whitehead
*Attorney, Agent, or Firm*—Ralph L. Marzocco

[57] ABSTRACT

A mechanical device for abrading the surfaces of workpieces is disclosed in which a power driven perforated abrasive coated endless belt comes into intimate parallel contact with a rotatably driven slotted disc platen. The perforated abrasive coated endless belt is oriented so that its noncoated side contacts the slotted disc platen. The periodic alignment of the slots of the revolving disc platen with the perforations of the abrasive coated endless belt allows an operator to continually observe a workpiece while its surface is being abraded.

1 Claim, 4 Drawing Figures

OBSERVABLE WORKPIECE ABRADING MACHINE

BACKGROUND OF THE INVENTION

Abrasive machining is a mechanical process of removal of excess material from the surface of a metal or a nonmetal through the use of abrasives as cutting tools which at the same time produces a surface finish. The abrasive machining process comprises the general classification of (a) the precision type as exemplified by the related processes of grinding, lapping, and honing; and (b) the non-precision type as exemplified by the related processes of polishing and buffing. In precision abrasive machining the abrasive agent moves and the workpiece is stationary, or the workpiece moves and the abrasive is stationary. Surface material is removed within close size limits and the desired finish is obtained, whereas in non-precision abrasive machining surface material is removed until the desired finish is obtained. In non-precision abrasive machining the workpiece is usually held in contact with the abrasive surface by hand or vice versa.

Abrasive are of two main types — natural and manufactured. Examples of abrasive stones found in nature are emery, sandstone, corundum. Silicon carbide and aluminum oxide are examples of the two most used abrasives. Diamonds can be classified as both natural and artificial.

Many kinds of machines have been built to bring the coated abrasive in contact with the workpiece. They may be broadly classified into two groups — the endless belt machines and the coated abrasive wheels. The five main types of belt machines are platen, contact wheel, formed wheel, centerless, and flexible belt. (Lindberg, R. A. *Processes and Materials of Manufacture*. Boston, Mass., Allyn and Bacon, 1964. p. 669–672.) The platen machine provides a support or platen for part of the belt surface. All these machine designs have a common disadvantage and that is that the operator can not view the surface that is being abrading as it is being abraded. To do this the operator must pull the workpiece away from the abrading belt.

SUMMARY OF THE INVENTION

This invention provides a method whereby continual viewing of the surface of a workpiece while it is being abraded is possible.

In accordance with this invention a rotatably driven slotted disc platen comes into contact with a driven perforated abrasive coated endless belt. The perforated abrasive coated endless belt is oriented so that its non-coated side contacts the slotted disc platen. Whenever the slots of the disc platen are aligned with the perforations of the abrasive coated endless belt, a workpiece positioned in this area of alignment can be observed by an operator. Although the slots of the disc platen are only periodically aligned with the perforations of the abrasive coated endless belt, because of the high rate of rotation of the disc platen and the high rate of travel of the abrasive coated endless belt, an operator's view of any workpiece held in the area of alignment appears to be continuous.

DESCRIPTION OF THE PREFERRED EMBODIMENT

Figure 1:
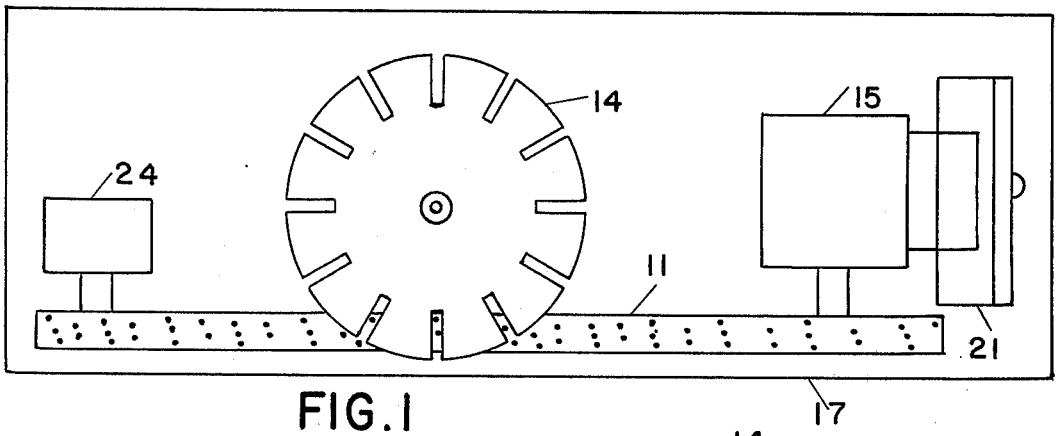
FIG. 1 is a diagrammatic top view of an abrading machine of the present invention.
Figure 2:
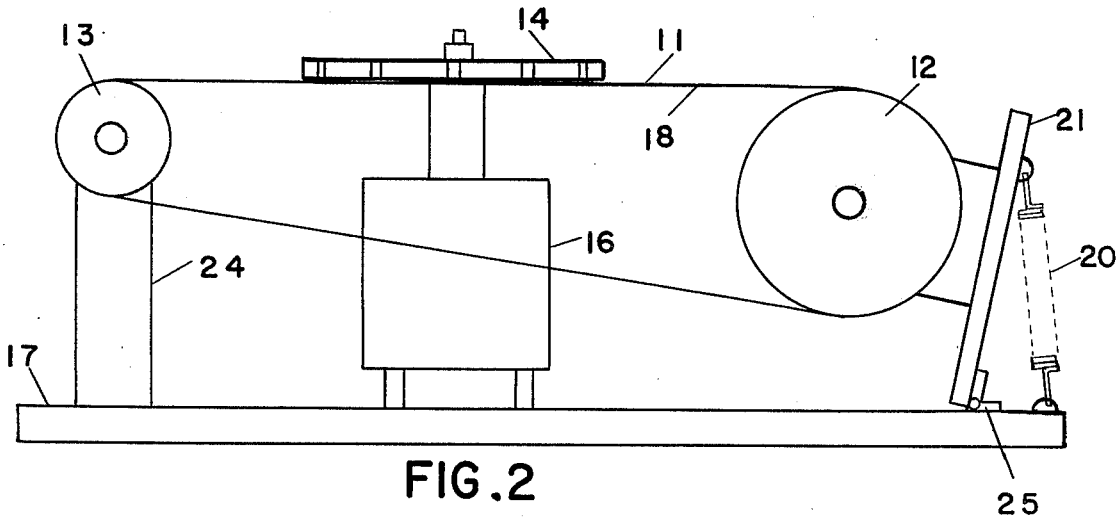
FIG. 2 is a diagrammatic side view of the abrading machine of FIG. 1.

Referring to the drawings, in FIG. 1 and FIG. 2, the abrading machine is somewhat diagrammatically illustrated as including a perforated abrasive coated endless belt unit and a rotatable slotted disc unit which are attached to base 17. Belt drive motor 15 is attached to belt drive motor mount 21 which in turn is attached to base 17 by means of a hinge 25. Tension is maintained on the perforated abrasive coated endless belt 11 by means of tension spring 20.

In FIG. 2, the perforated abrasive coated endless belt 11 is shown as wrapped around idler wheel 13 and drive wheel 12 which is connected to belt drive motor 15. Idler wheel 13 is attached to idler wheel mount 24 which in turn is attached to base 17. The rotatable slotted disc 14, which functions as a rotatable platen for the perforated abrasive coated endless belt 11, is driven by disc drive motor 16.

The perforated abrasive coated endless belt 11 is wrapped about idler wheel 13 and drive wheel 12 so that the abrasive coated side is in contact with the surfaces of idler wheel 13 and drive wheel 12, and the non-abrasive side of the perforated abrasive coated endless belt 11 is in intimate parallel contact with the rotatable slotted disc 14.

Figure 3:
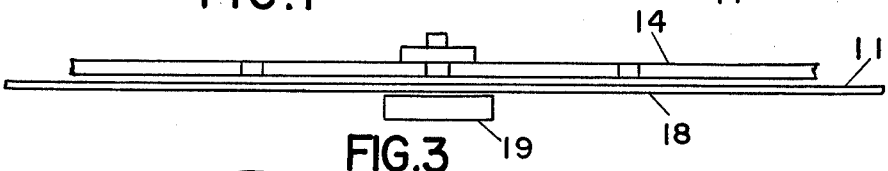
FIG. 3 is an enlarged fragmentary sectional side view of a rotatable slotted disc and perforated abrasive coated endless belt of FIG. 2.
Figure 4:
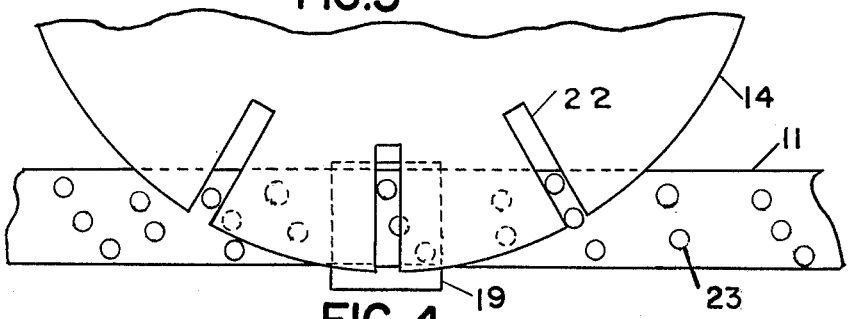
FIG. 4 is an enlarged fragmentary sectional top view of a rotatable slotted disc and perforated abrasive coated endless belt of FIG. 1.

In FIG. 3 a workpiece 19 is shown positioned so that it contacts the abrasive coated side 18 of the perforated abrasive coated endless belt 11. As shown in FIG. 4, whenever a slot 22 of the rotatable slotted disc 14 is momentarily aligned with perforations 23 of the perforated abrasive coated endless belt 11, an operator can view workpiece 19. Because rotatable slotted disc 14 and perforated abrasive coated endless belt 11, upon energizing disc drive motor 16 and belt drive motor 15, both travel at high rates of speed; and operator's view of workpiece 19 is not intermittent, but is continuous.

While I have shown and described herein a certain embodiment of my invention, I intend to cover as well any change or modification therein which may be made without departing from its spirit and scope.

I claim as my invention:

1. Apparatus for abrasive machining the surface of material to produce a finish, which comprises:

a. a workpiece platen comprising a disc rotatable about an axis perpendicular to said pulleys and having spaced perforations for periodic alignment with the perforation of the belt;

b. means for maintaining level of belt tension;

c. a perforated rotatable disc periodically aligned with the perforations of the belt to permit continual observation of the workpiece;

d. a base to support the belt in intimate parallel contact with the rotatable disc; and e. means for driving the belt and the disc.

* * * * *